US009041745B2

(12) United States Patent
Park et al.

(10) Patent No.: US 9,041,745 B2
(45) Date of Patent: May 26, 2015

(54) METHOD OF BOOSTING A LOCAL DIMMING SIGNAL, BOOSTING DRIVE CIRCUIT FOR PERFORMING THE METHOD, AND DISPLAY APPARATUS HAVING THE BOOSTING DRIVE CIRCUIT

(75) Inventors: Se-Ki Park, Suwon-si (KR); Joon-Hak Oh, Seoul (KR); Gi-Cherl Kim, Yongin-si (KR); Gi-Chang Park, Yongin-si (KR); Joong-Hyun Kim, Suwon-si (KR); Dong-Min Yeo, Asan-si (KR); Nam-Ok Kwon, Cheonan-si (KR); Yong-Hoon Kwon, Asan-si (KR)

(73) Assignee: Samsung Display Co., Ltd. (KR)

( * ) Notice: Subject to any disclaimer, the term of this patent is extended or adjusted under 35 U.S.C. 154(b) by 901 days.

(21) Appl. No.: 12/474,659

(22) Filed: May 29, 2009

(65) Prior Publication Data

US 2009/0295841 A1 Dec. 3, 2009

(30) Foreign Application Priority Data

Jun. 3, 2008 (KR) ..... 10-2008-0052216
Oct. 6, 2008 (KR) ..... 10-2008-0097489

(51) Int. Cl.
*G09G 5/10* (2006.01)
*H05B 33/08* (2006.01)
(Continued)

(52) U.S. Cl.
CPC ..... *H05B 33/0818* (2013.01); *G09G 3/3426* (2013.01); *G09G 2320/0633* (2013.01); *G09G 2320/064* (2013.01); *G09G 2330/021* (2013.01);
(Continued)

(58) Field of Classification Search
CPC ..... G09G 2320/0633; G09G 2320/064; G09G 2360/16; G09G 2320/021
USPC ..... 345/102, 690, 89; 315/297
See application file for complete search history.

(56) References Cited

U.S. PATENT DOCUMENTS 4,703,405 A 10/1987 Lewin
6,172,812 B1 1/2001 Haaland et al.
(Continued)

FOREIGN PATENT DOCUMENTS

JP 2005-258403 9/2005
JP 2007-310319 11/2007
KR 10-0759902 9/2007

OTHER PUBLICATIONS

English Abstract for JP Pat. Pub. No. 2005-258403, 2 pages.
(Continued)

*Primary Examiner* — Jonathan Blancha
(74) *Attorney, Agent, or Firm* — Innovation Counsel LLP

(57) ABSTRACT

There is provided a method of boosting a local dimming signal. In the method, it is determined whether or not local dimming signals, which are applied for individually driving light source blocks per frame, satisfy boosting conditions. Then, a predetermined local dimming signal corresponding to at least one of the light source blocks is boosted to a reference luminance value when the local dimming signals continuously satisfy the boosting conditions, and the boosting luminance of the predetermined local dimming signal at the reference luminance value is gradually decreased after a light adaptation time of an observer's eye. When the luminance of light source blocks that are boosted is gradually decreased before the light adaptation time or luminance of light source blocks that will be boosted is gradually increased to the light adaptation time, power consumption required to boost the light source blocks may be decreased.

20 Claims, 10 Drawing Sheets

(51) Int. Cl.
*G09G 3/34* (2006.01)
*H05B 41/392* (2006.01)

(52) U.S. Cl.
CPC ..... *G09G 2360/16* (2013.01); *H05B 33/086* (2013.01); *H05B 41/3927* (2013.01)

(56) References Cited

U.S. PATENT DOCUMENTS

| | | | | |
|---|---|---|---|---|
| 6,456,266 | B1 * | 9/2002 | Iba et al. | 345/87 |
| 6,529,212 | B2 | 3/2003 | Miller et al. | |
| 7,312,777 | B2 * | 12/2007 | Miyata et al. | 345/89 |
| 8,102,360 | B2 * | 1/2012 | Chan et al. | 345/102 |
| 2001/0028335 | A1 * | 10/2001 | Hasegawa et al. | 345/76 |
| 2005/0206589 | A1 * | 9/2005 | Miyachi et al. | 345/73 |
| 2006/0167670 | A1 | 7/2006 | Deering | |
| 2007/0046829 | A1 * | 3/2007 | Su et al. | 348/678 |
| 2007/0296673 | A1 * | 12/2007 | Kang et al. | 345/92 |
| 2008/0111502 | A1 * | 5/2008 | Kim et al. | 315/294 |
| 2008/0252666 | A1 | 10/2008 | Chen et al. | |

OTHER PUBLICATIONS

English Abstract for JP Pat. Pub. No. 2007-310319, 1 page.
English Abstract for KR Pat. Pub. No. 10-0759902, 1 page.
C. Liu and M.D. Fairchild, "The surround color and color matching functions," *IS&T/SID 14th Color Imaging Conference*, Scottsdale, 203-208 (2006).
Changmeng Liu, Mark D. Fairchild: Measuring the Relationship between Perceived Image Contrast and Surround Illumination. *Color Imaging Conference 2004*: 282-288.
U.S. Appl. No. 12/410,904, filed Mar. 25, 2009, 51 pages.
U.S. Appl. No. 12/355,342, filed Jan. 16, 2009, 30 pages.
J. Van Derlofske and J. Bullough, "What is Glare?" NHTSA Workshop: Balancing Visibility and Glare; Transportation Lighting Group Lighting Research Center Rensselaer Polytechnic Institute, 34 pages.
"Light: Glare" Ecotect Wiki, 2 pages.

* cited by examiner

METHOD OF BOOSTING A LOCAL DIMMING SIGNAL, BOOSTING DRIVE CIRCUIT FOR PERFORMING THE METHOD, AND DISPLAY APPARATUS HAVING THE BOOSTING DRIVE CIRCUIT

PRIORITY STATEMENT

This application claims priority under 35 U.S.C. §119 to Korean Patent Application No. 10-2008-0052216, filed on Jun. 3, 2008, and Korean Patent Application No. 10-2008-0097489, filed on Oct. 6, 2008 in the Korean Intellectual Property Office (KIPO), the contents of which are herein incorporated by reference in their entireties.

BACKGROUND OF THE INVENTION

1. Field of the Invention

Example embodiments of the present invention relate to a method of boosting a local dimming signal, a boosting drive circuit for performing the method, and a display apparatus having the boosting drive circuit. More particularly, example embodiments of the present invention relate to a method of boosting a local dimming signal capable of individually driving light source unit blocks, a boosting drive circuit for performing the method, and a display apparatus having the boosting drive circuit.

2. Description of the Related Art

Generally, a liquid crystal display (LCD) apparatus includes an LCD panel displaying an image using optical transmittance of liquid crystal molecules, and a backlight assembly disposed below the LCD panel to provide the LCD panel with light.

The LCD panel includes an array substrate, a color filter substrate and a liquid crystal layer. The array substrate includes a plurality of pixel electrodes and a plurality of thin-film transistors (TFTs) electrically connected to the pixel electrodes. The color filter substrate faces the array substrate and has a common electrode and a plurality of color filters. The liquid crystal layer is interposed between the array substrate and the color filter substrate.

When an electric field generated between the pixel electrode and the common electrode is applied to the liquid crystal layer, the arrangement of liquid crystal molecules of the liquid crystal layer is altered to change optical transmissivity, so that an image is displayed. Here, the LCD panel realizes a white image of a high luminance when an optical transmittance is increased to maximum, and the LCD panel realizes a black image of a low luminance when an optical transmittance is decreased to minimum.

However, it is difficult for the liquid crystal layer to be arranged in a uniform direction, so that light leakage may be generated when the LCD panel displays an image corresponding to a low gray level. That is, it is difficult for the LCD panel to display a fully black image at a low gray level, so that the contrast ratio of an image displayed on the LCD panel may be decreased.

In order to prevent the contrast ratio of an image from being decreased, a method of local dimming a light source has been developed, which individually controls light amounts according to position to drive the light source. In the method of local dimming the light source, the light source is divided into a plurality of light-emitting blocks to control the light amounts of the light-emitting blocks in correspondence with black and white areas of a display area of the LCD panel corresponding to the light-emitting blocks.

Recently, a method of local dimming a light source has been developed, which enhances the luminance corresponding to predetermined light source blocks relative to peripheral light source blocks. The method of local dimming the light source represents a technology which enhances a dynamic contrast ratio with respect to a conventional local dimming method.

However, since the local boosting method is a technology which enhances the luminance of the predetermined light source blocks relative to the peripheral light source blocks, power consumption may be increased when the local boosting method is used.

SUMMARY OF THE INVENTION

Example embodiments of the present invention provide a local dimming signal boosting method capable of decreasing power consumption.

Example embodiments of the present invention provide a boosting drive circuit performing the local dimming signal boosting method.

Example embodiments of the present invention provide a display device having the above-mentioned boosting drive circuit.

According to one aspect of the present invention, there is provided a method of boosting a local dimming signal. In the method, it is determined whether or not local dimming signals, which are applied for individually driving light source blocks per frame, satisfy boosting conditions. Then, a predetermined local dimming signal corresponding to at least one of the light source blocks is boosted to a reference luminance value when the local dimming signals continuously satisfy the boosting conditions, and the boosting luminance of the predetermined local dimming signal at the reference luminance value is gradually decreased after a light adaptation time of an observer's eye.

In boosting the predetermined local dimming signal to the reference luminance value, and gradually decreasing the boosting luminance, the number of frames (hereinafter, the number of boosting frames) may be counted, of which the predetermined local dimming signal is boosted from a first boosting frame to a current boosting frame of the predetermined local dimming signal. The predetermined local dimming signal may be boosted to the reference luminance value when the number of boosting frames is smaller than that of threshold frame, and then the boosting luminance of the predetermined local dimming signal may be decreased when the number of boosting frames is greater than or equal to that of threshold frame. Here, a time corresponding to the threshold frame may be less than or equal to the light adaptation time of an observer's eye.

In boosting the predetermined local dimming signal to the reference luminance value, and gradually decreasing the boosting luminance, the number of boosting frames may be further reset when the local dimming signals satisfy counting reset conditions. The counting conditions may include that at least one of the local dimming signals is changed differently from a local dimming signal of a previous frame.

Moreover, in the method, the number of boosting frames may be further reset when the local dimming signals do not satisfy the boosting conditions.

A boosting luminance of the predetermined local dimming signal after the light adaptation time may be gradually decreased to a luminance value which the predetermined local dimming signal is boosted (hereinafter, a primary luminance value). Here, the reference luminance value may have a range of about 110% to about 500% with respect to the primary luminance value. Moreover, the reference luminance value may be the maximum luminance value at the light source block.

The boosting luminance of the predetermined local dimming signal after the light adaptation time may be decreased in a linear form or an exponential function form from the reference luminance value to the primary luminance value.

The decreasing of the boosting luminance of the predetermined local dimming signal after the light adaptation time may be performed by decreasing at least one of the duty and the amplitude of the predetermined local dimming signal.

The boosting conditions may include that a remaining signal (hereinafter, a remaining local dimming signals), of which the predetermined local dimming signal is excluded from the local dimming signals, realizes a black luminance, and the remaining local dimming signals occupy more than a reference percent with respect to all of the local dimming signals. Here, the maximum value of the duty at the remaining local dimming signals corresponding to the black luminance may have a range of about 10% to about 40%. Moreover, the reference percent may have a range of about 45% to about 55%.

According to another aspect of the present invention, a boosting drive circuit includes a boosting condition determining part and a boosting driving part. The boosting condition determining part receives a plurality of local dimming signals for individually driving light source blocks per frame and determining whether or not the local dimming signals satisfy boosting conditions. The boosting driving part is controlled by the boosting condition determining part. The boosting driving part boosts a predetermined local dimming signal corresponding to at least one of the light source blocks to a reference luminance value when the local dimming signals continuously satisfy the boosting conditions, and gradually decreases the boosting luminance of the predetermined local dimming signal at the reference luminance value after a light adaptation time of an observer's eye.

The boosting driving part may include a counting part and a boosting part. The counting part may count the number of frames (hereinafter, a boosting frame number) which the predetermined dimming signal is boosted from a first boosting frame to a current boosting frame. The boosting part may boost the predetermined local dimming signal to the reference luminance value when the boosting frame number is smaller than the number of threshold frames, and may decrease the boosting luminance of the predetermined local dimming signal when the boosting frame number is greater than or equal to the number of threshold frames.

The boosting driving part may further include a counting resetting part controlling the counting part to reset the boosting frame number when the local dimming signals satisfy counting reset conditions. Here, the counting reset part may control the counting part to reset the boosting frame number when the local dimming signals satisfy the boosting conditions.

According to still another aspect of the present invention, a display apparatus includes a display unit, a backlight unit and a local dimming controller unit. The display unit displays images using light. The backlight unit is disposed below the display unit. The backlight unit includes a plurality of light source blocks providing light to the display unit. The local dimming controller unit includes a local dimming drive circuit and a boosting drive circuit. The local dimming drive circuit receives an image signal from an external device to generate local dimming signals for individually driving the light source blocks in response to the image signal. The boosting drive circuit receives the local dimming signals from the local dimming drive circuit per frame. The boosting drive circuit includes a boosting condition determining part and a boosting driving part. The boosting condition determining part receives a plurality of local dimming signals for individually driving light source blocks per frame and determining whether or not the local dimming signals satisfy boosting conditions. The boosting driving part is controlled by the boosting condition determining part. The boosting driving part boosts a predetermined local dimming signal corresponding to at least one of the light source blocks to a reference luminance value when the local dimming signals continuously satisfy the boosting conditions, and gradually decreases the boosting luminance of the predetermined local dimming signal at the reference luminance value after a light adaptation time of an observer's eye.

The local dimming controller unit may provide the display unit with an image driving signal in response to the image signal.

According to one aspect of the present invention, there is provided a method of boosting a local dimming signal. In the method, it is determined whether or not local dimming signals, which are applied for individually driving light source blocks per frame, satisfy boosting conditions. Then, a predetermined local dimming signal for driving a plurality of light source blocks which will be boosted from a primary luminance value to a reference luminance value is gradually increased and boosted, when the local dimming signals satisfy the boosting conditions.

The gradually increasing the predetermined dimming signals may be performed by increasing at least one of the duty and the amplitude of the predetermined local dimming signal.

In the method of boosting a local dimming signal, determining whether or not the size of a white image is decreased by analyzing an image signal applied from an external device per frame may be further performed. Here, boosting the predetermining dimming signals from the primary luminance value to the reference luminance value may be performed when the size of the white image is decreased and the local dimming signals satisfy the boosting conditions.

The boosting the predetermining dimming signals from the primary luminance value to the reference luminance value may increase a luminance value which the primary luminance value to the reference luminance value before a light adaptation time of an observer's eye.

Moreover, the boosting the predetermining dimming signals from the primary luminance value to the reference luminance value may increase a luminance value from the primary luminance value to the reference luminance value so as to substantially correspond with a distribution state according to a solid angle of a cone cell in an observer's eye. Here, the boosting the predetermining dimming signals from the primary luminance value to the reference luminance value may increase a luminance value in an exponential function form from the primary luminance value to the reference luminance value.

According to some example embodiments of the present invention, when the luminance of light source blocks that are boosted is gradually decreased before the light adaptation time or the luminance of light source blocks that will be boosted is gradually increased to the light adaptation time, power consumption required to boost the light source blocks may be decreased.

BRIEF DESCRIPTION OF THE DRAWINGS

The above and other features and advantages of the present invention will become more apparent by describing in detailed example embodiments thereof with reference to the accompanying drawings, in which.

DETAILED DESCRIPTION OF THE INVENTION

Figure 1:
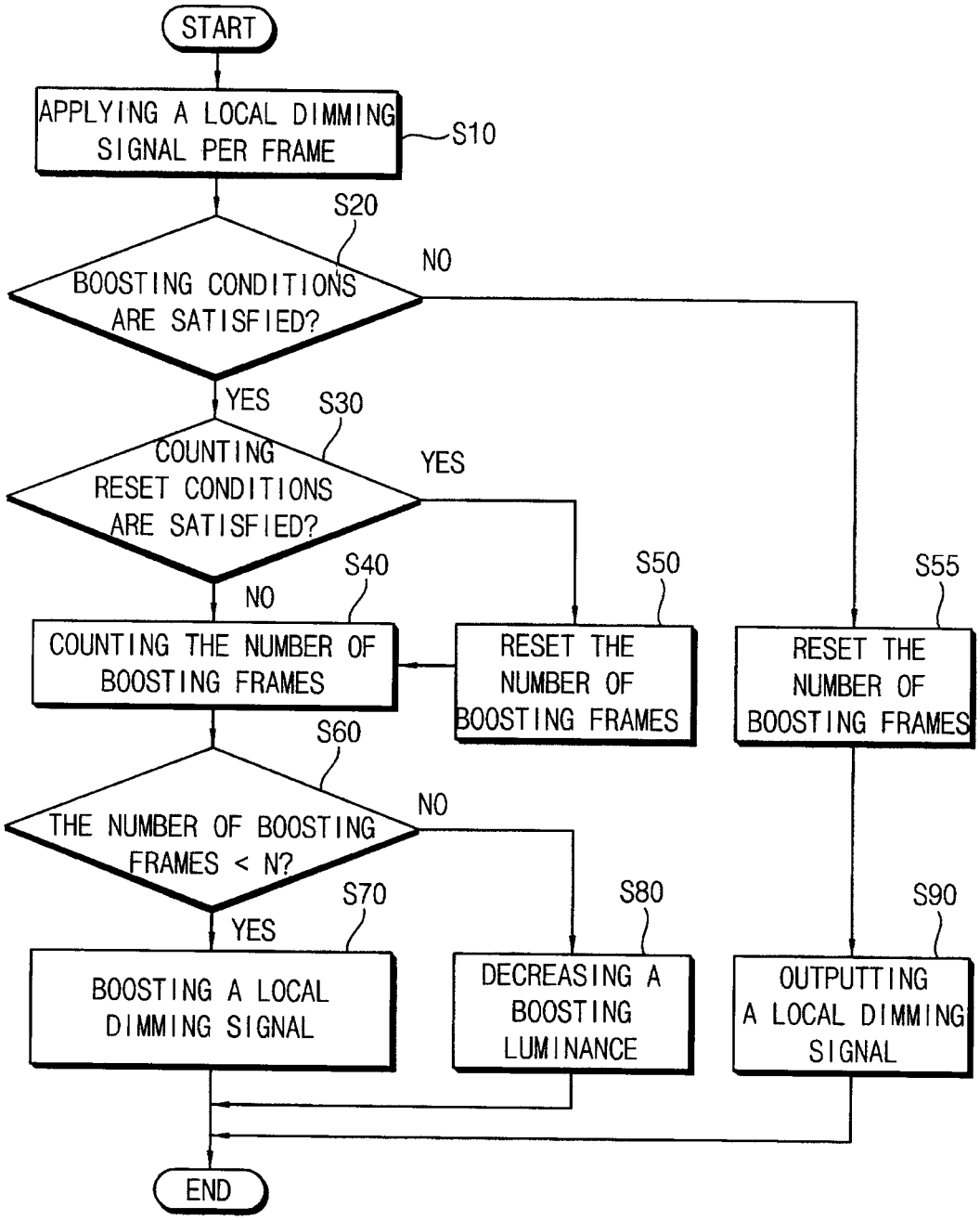
FIG. 1 is a flowchart diagram illustrating a method of boosting a local dimming signal according to Embodiment 1 of the present invention.

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Example Embodiment 1

Figure 2:
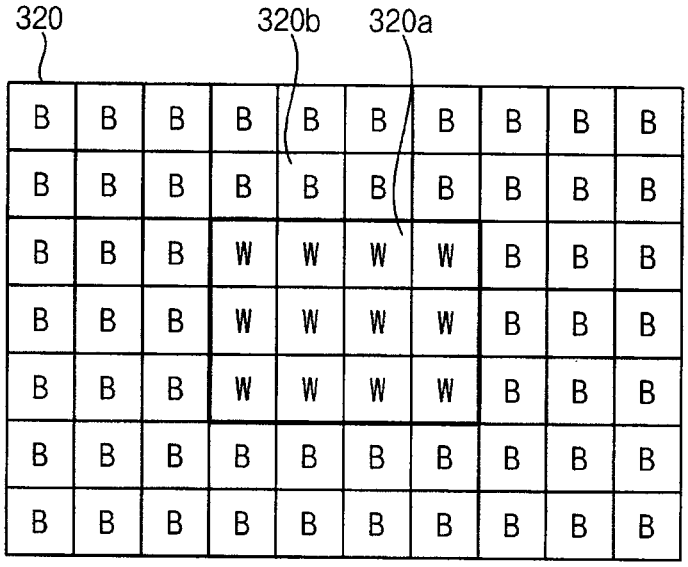
FIG. 2 is a plan view illustrating a boosting condition of FIG. 1.

FIG. 1 is a flowchart diagram illustrating a method of boosting a local dimming signal according to Embodiment 1 of the present invention. FIG. 2 is a plan view illustrating a boosting condition of FIG. 1.

Referring to FIGS. 1 and 2, in a local dimming signal boosting method in accordance with the present embodiment, a local dimming signal for individually driving light source blocks 320 which generate light is received per frame (step S10).

In the present embodiment, the light source blocks 320 may be classified into at least one of a predetermined light source block 320*a* and remaining light blocks 320*b* except for the predetermined light source block 320*a*. For example, when the light source blocks 320 are arranged in seven rows and ten columns, the predetermined light source blocks 320*a* may be arranged in the center of the light source blocks 320 in three rows and four columns and the remaining light source blocks 320*b* may be arranged in a peripheral of the predetermined light source blocks 320*a*. Here, the predetermined light source blocks 320*a* may be changed per frame. Alternatively, the predetermined light source blocks 320*a* may be maintaining in a uniform or may be not.

Moreover, in the present embodiment, the local dimming signals may be classified into a plurality of predetermined local dimming signals for driving the predetermined light source blocks 320*a* and a plurality of remaining local dimming signals for driving the remaining light source blocks 320*b*. Here, the predetermined local dimming light sources may be changed per frame. Alternatively, the predetermined local dimming light source may be maintaining in a uniform or may be not.

Then, it is determined whether or not the local dimming signals satisfy boosting conditions (step S20). Here, the boosting conditions may include two conditions.

A first condition is that each of the remaining local dimming signals should include data capable of realizing a black luminance.

In order to realize the black luminance by the remaining local dimming signals, a duty of the remaining local dimming signals should have a value of no more than a reference value. F or example, the reference value may have a range of about 10% to about 40%. That is, the maximum value of duty at the remaining local dimming signals corresponding to the black luminance may be about 10% to about 40%. For example, the maximum value of duty may be about 10%.

A second condition is that the remaining local dimming signals should be positioned in more than a reference percent with respect to the whole of the local dimming signals.

The reference percent may have a range of about 45% to about 55%. For example, the reference percent may be about 50%. That is, the remaining local dimming signals should be positioned in more than about 50% with respect to the whole of the local dimming signals.

Then, when the local dimming signals satisfy the boosting conditions, it is checked whether or not the local dimming signals satisfy counting reset conditions (step S30). Here, the counting reset condition represents that at least one of the local dimming signals is changed different from local dimming signals of a previous frame. For example, when an image displayed on a display device is changed, at least one of the local dimming signals may be changed different from the local dimming signals of the previous frame.

Then, when the local dimming signals satisfy the counting reset conditions, the number of frames, of which the predetermined local dimming signal is boosted from an initial boosting time to a current boosting time (hereinafter, a boosting frame number), are counted (step S40). Here, an initial setting value of the boosting frame number is zero.

On the other hand, when the local dimming signals satisfy the counting reset conditions, the boosting frame number is reset (step S50). That is, the boosting frame number is reset as zero that is an initial setting value. After the boosting frame number is reset, the boosting frame number is again counted (step S40).

Thus, when the local dimming signals continuously satisfy the boosting conditions, the boosting frame number may be repeatedly counted.

Then, the boosting frame number is compared with a threshold frame number N (step S60). Here, a time corresponding to the number of threshold frames N may be substantially less than or equal to light adaptation time of an observer' eye.

Then, when the boosting frame number is smaller than the threshold frame number N, the predetermined local dimming signals are boosted to a reference luminance value (step S70). On the other hand, when the boosting frame number is substantially greater than or equal to the threshold number N, a boosting luminance of the predetermined local dimming signal is gradually decreased per frame (step S80).

It is checked whether or not the local dimming signals satisfy the boosting conditions (step S20), the boosting frame number is reset when the local dimming signals do not satisfy the boosting conditions. Then, the local dimming signals are not boosted to be outputted (step S90).

Figure 3:
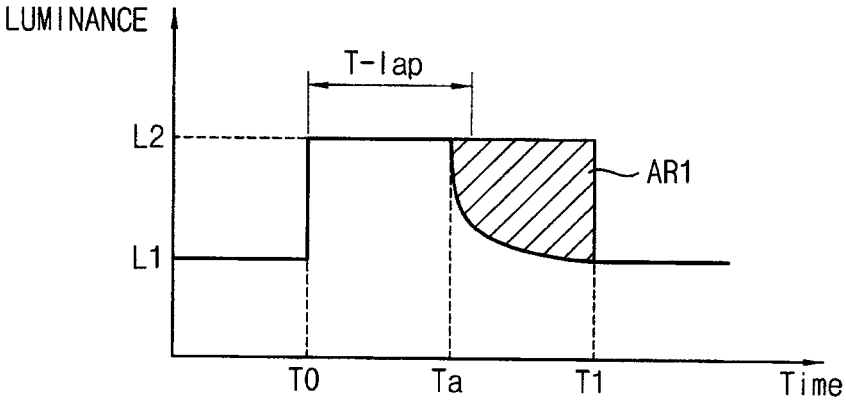
FIG. 3 is a graph repeatedly illustrating a variation of a boosting luminance in a predetermined local dimming signal of FIG. 1.

FIG. 3 is a graph repeatedly illustrating a variation of a boosting luminance in a predetermined local dimming signal of FIG. 1.

Referring to FIGS. 2 and 3, when a time which luminance is boosted is a boosting start time T0, a time which luminance is begun to be decreased is a boosting start-of-decreasing time Ta (also hereafter, boosting intermediate time Ta), and a time which luminance is returned to a normal value is a boosting returning time T1 at the predetermined light source blocks 320*a*, luminance value of the predetermined local dimming signals is increased from the primary luminance value L1 to the reference luminance value L2 in correspondence with the boosting start time T0 to be maintaining to the boosting decreasing time Ta. Then, luminance value of the predetermined local dimming signals is decreased at the boosting start-of-decreasing time Ta to be returned to the primary luminance value L1 at the boosting returning time T1. Here, after the boosting decreasing start time Ta, luminance value of the predetermined local dimming signals may be decreased from the reference luminance value L2 to the primary luminance value L1. For example, the luminance value of the predetermined local dimming signals may be decreased in an exponential function form. Here, the boosting decreasing start time Ta may be a value corresponding to the threshold frame number N in FIG. 2.

In the present embodiment, a time interval between the boosting start time T0 and the boosting decreasing time Ta is substantially equal to or shorter than the light adaptation time T-lap in which a human eye becomes adapted to glare. Even though a time boosting the predetermined light source blocks 320*a* is greater than the light adaptation time T-lap, the human eye becomes adapted to glare of boosted luminance, so that boosting efficiency of the predetermined light source blocks 320*a* may be decreased.

As described above, when a luminance value of the predetermined local dimming signals is decreased after the boosting decreasing time Ta that is before the light adaptation time T-lap, a luminance value of the predetermined local dimming signals is maintaining as the reference luminance value L2 to the boosting returning time T1, however, power consumption required to boost the predetermined light source blocks 320*a* may be decreased by a hatching area AR1.

Figure 4:
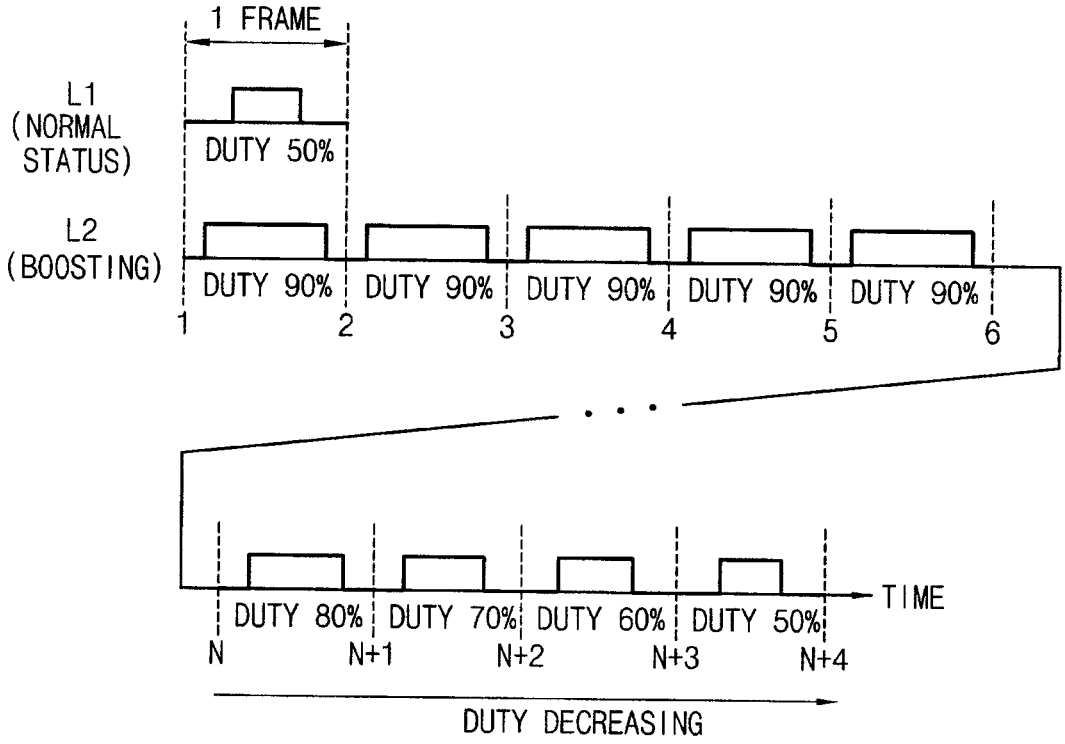
FIGS. 4 and 5 are timing diagrams illustrating a state in which a boosting luminance is decreased at a predetermined local dimming signal of FIG. 1.
Figure 5:
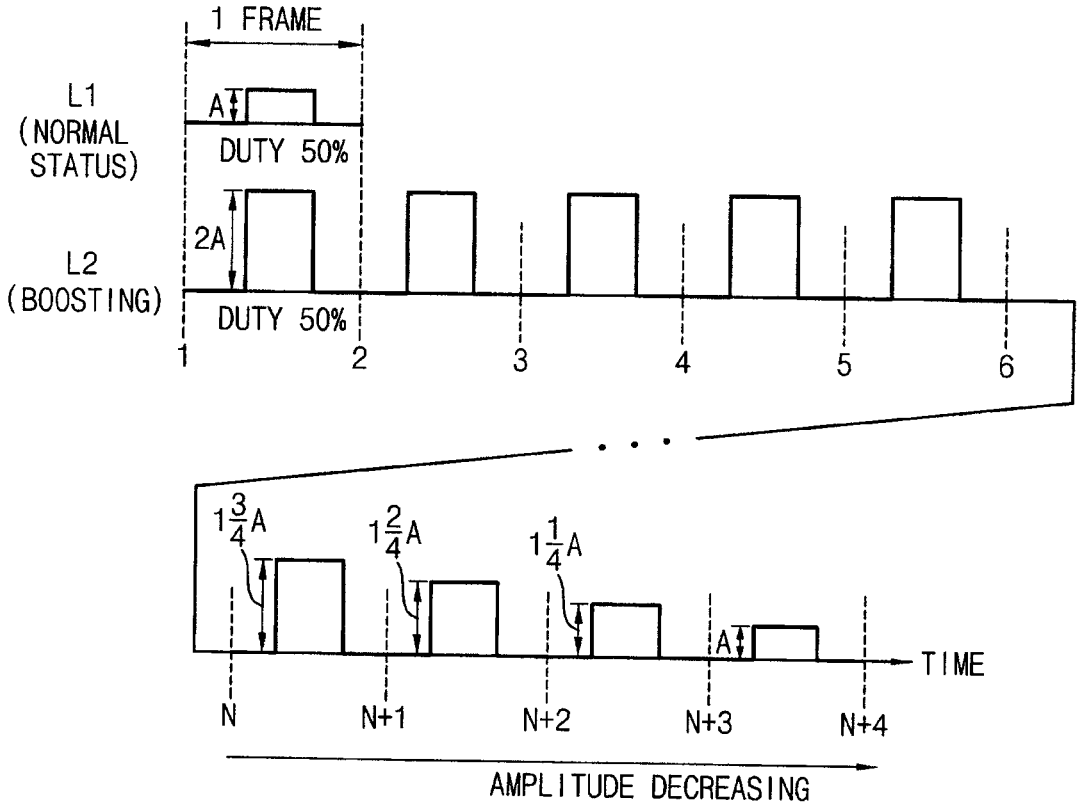

FIGS. 4 and 5 are timing diagrams illustrating a state in which a boosting luminance is decreased at a predetermined local dimming signal of FIG. 1.

Referring to FIGS. 1 to 5, when the boosting frame number is smaller than the threshold frame number N, the predetermined local dimming signals are boosted from the primary luminance value L1 to the reference luminance value L2.

The primary luminance value L1 represents a luminance value corresponding to the predetermined local dimming signals before the predetermined local dimming signals are boosted. Here, the reference luminance value L2 may have a value of greater than or equal to about 110% with respect to the primary luminance value L1. The reference luminance value L2 may be the maximum luminance value in the light source block 132. For example, the reference luminance value L2 may have a range of about 110% t about 500% with respect to the primary luminance value L1. That is, when the primary luminance value L1 is about 500 nits, the reference luminance value L2 may be greater than or equal to about 550 nits.

Referring to again FIG. 4, a boosting of the predetermined local dimming signals may be realized by an increasing of duty of the predetermined dimming signals. For example, when duty of the predetermined local dimming signals corresponding to the primary luminance value L1 is about 50%, duty of the predetermined local dimming signals corresponding to the reference luminance value L2 may be about 90%.

In this embodiment, when the local dimming signals continuously satisfy the boosting conditions and the predetermined dimming signals are not changed, the predetermined local dimming signals are continually boosted from the primary luminance L1 to the reference luminance value L2 and the boosting frame number is continually counted per frame.

When the boosting frame number is equal to or greater than the threshold frame number N, a boosting luminance of the predetermined local dimming signals is decreased from the reference luminance value L2 to the primary luminance value L1. For example, duty of the predetermined local dimming signals may be gradually decreased from about 90% to about 50%.

Here, when the boosting frame number is greater than or equal to the threshold frame number N, a boosting luminance of the predetermined local dimming signal may be decreased in a linear form or an exponential function form from the reference luminance value L2 to the primary luminance value L1.

Referring to FIG. 5, a boosting of the predetermined local dimming signals may be realized by an increasing of amplitude of the predetermined local dimming signals. For example, the amplitude of the predetermined local dimming signals may be increased twice.

Then, when the threshold frame number N is greater than or equal to the boosting frame number, a boosting luminance of the predetermined dimming signals is gradually decreased from the reference luminance value L2 to the primary luminance value L1. That is, amplitude of the predetermined local dimming signals may be gradually decreased to initial amplitude before the predetermined local dimming signals are boosted.

In the present embodiment, increasing or decreasing of the boosting luminance of the predetermined local dimming signals may be realized by a combination of increasing or decreasing of the duty and the amplitude of the predetermined local dimming signals.

Figure 6:
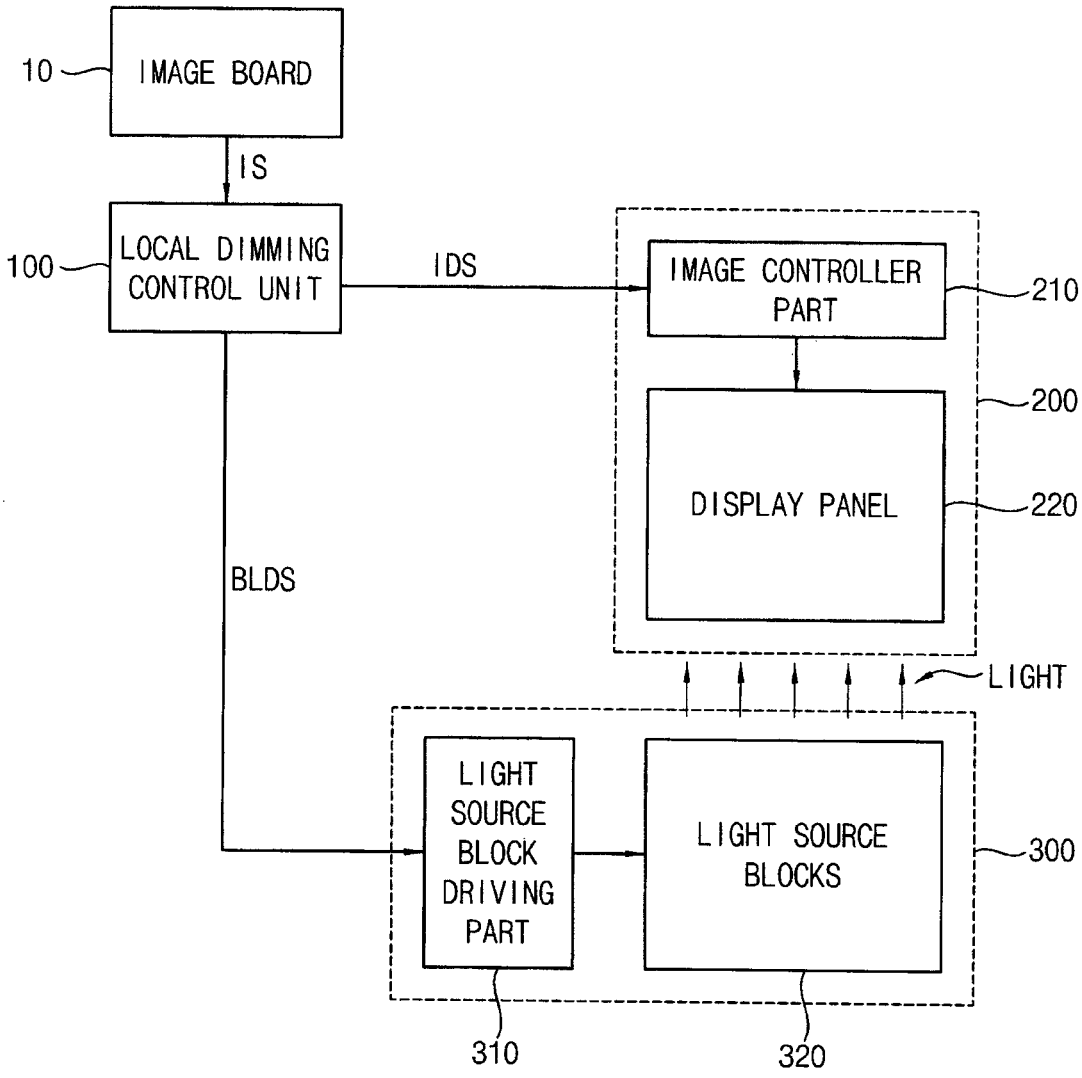
FIG. 6 is a block diagram illustrating a display device according to one embodiment for performing a method of boosting a local dimming signal of FIG. 1.

FIG. 6 is a block diagram illustrating a display device according to one embodiment for performing a method of boosting a local dimming signal of FIG. 1.

Referring to FIG. 6, a display device according to the present embodiment may include a local dimming controller unit 100, a display unit 200 and a backlight unit 300.

The local dimming controller unit 100 receives an image signal IS from an external image board 10 to output an image driving signal IDS and a plurality of boosting local dimming signals BLDS in response to the image signal IS.

The display unit 200 receives the image driving signal IDS from the local dimming controller unit 100 to display image in response to the image driving signal IDS. Alternatively, the display unit 200 may directly receive the image driving signal IDS from the image board 10.

The display unit 200 may include an image controller part 210 and a display panel 220. The image controller part 210 receives the image driving signal IDS from the local dimming controller unit 100 to control the display panel 220 in response to the image driving signal IDS. The display panel 220 may be controlled by the image controller part 210 to display images by using light generated from the backlight unit 300. The display panel 220 may include a first substrate having a plurality of thin-film transistors and a plurality of pixel electrodes, a second substrate opposite to the first substrate to have a plurality of color filters and a common electrode, and a liquid crystal layer interposed between the first and second substrates.

The backlight unit 300 is disposed below the display panel 220. The backlight unit 300 receives the boosting local dimming signals BLDS from the local dimming controller unit 100 to provide the display panel 220 with light in response to the boosting local dimming signals BLDS.

The backlight unit 300 may include a light source block driving part 310 and a plurality of light source blocks 320 electrically connected to the light source block driving part 310.

The light source block driving part 310 receives the boosting local dimming signals BLDS from the local dimming local controller unit 100 to individually control the light source blocks 320 in response the boosting local dimming signals BLDS.

The light source blocks 320 is individually controlled by the light source block driving part 310 to generate light. Each of the light source blocks 320 includes at least one of light source. The light source may be at least one of light-emitting diodes (LEDs), a cold cathode fluorescent lamp (CCFL), a hot cathode fluorescent lamp (HCFL) and a flat light source. The LEDs may include a red LED, a green LED and a blue LED. Alternatively, the LEDs may include a white LED.

The display device may display images which a dynamic contrast ratio is superior due to the boosting local dimming signals BLDS.

Figure 7:
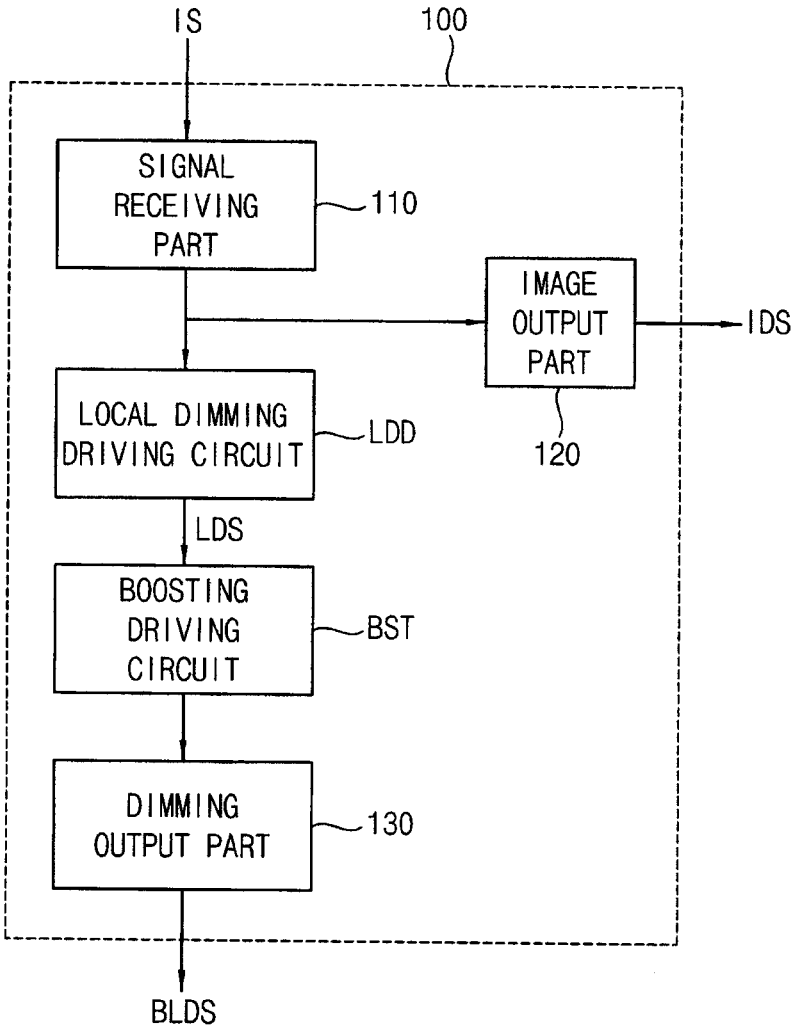
FIG. 7 is an enlarged block diagram illustrating a local dimming controller unit of FIG. 6.

FIG. 7 is an enlarged block diagram illustrating a local dimming controller unit of FIG. 6.

Referring to FIGS. 6 and 7, the local dimming controller unit 100 may include a signal receiving part 110, an image output part 120, a local dimming drive circuit LDD, a boosting drive circuit BST and a dimming output part 130.

The signal receiving part 110 receives the image signal IS from the image board 10 to output the image signal IS to the image output part 120 and the local dimming drive circuit LDD. The signal receiving part 110 may alter a voltage level or a form of the image signal IS to output the altered image signal IS.

The image output part 120 receives the image signal IS from the signal receiving part 110 to output the image driving signal IDS to the display unit 200.

A driving part (not shown) may be disposed between the signal receiving part 110 and the image output part 120, which processes the image signal IS. For example, the driving part may be a buffer memory.

The local dimming drive circuit LDD receives the image signal IS from the signal receiving part 110 to output a plurality of local dimming signals LDS for driving the light source blocks 320 to the boosting drive circuit BST in response to the image signal IS.

For example, the local dimming drive circuit LDD may include a representative value extracting part which extracts a representative luminance value from each of the light source blocks 320.

The boosting drive circuit BST receives the local dimming signals LDS from the local dimming drive circuit LDD to output the boosting local dimming signals BLDS in response to the local dimming signals LDS. The boosting drive circuit BST may includes a drive circuit for performing the local dimming signal boosting method as described in FIGS. 1 to 4.

The dimming output part 130 receives the boosting local dimming signals BLDS from the boosting drive circuit BST to output the boosting local dimming signals BLDS to the backlight unit 300. The dimming output part 130 may change a voltage level or type of the boosting local dimming signals BLDS.

Figure 8:
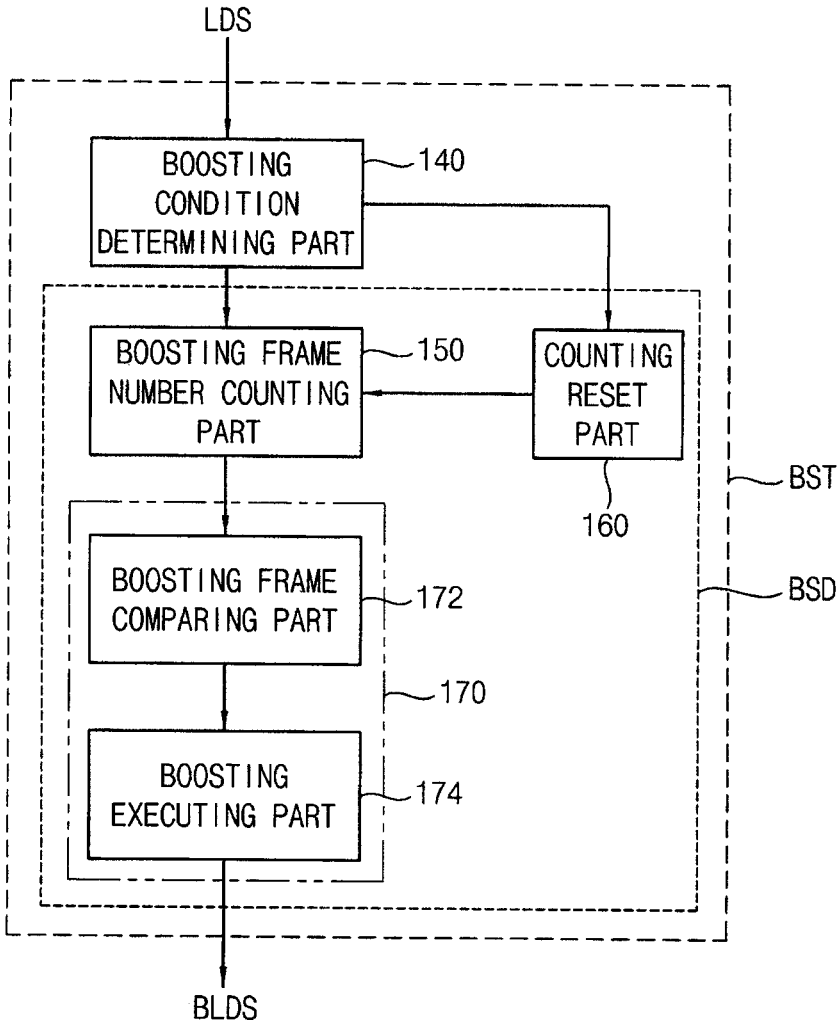
FIG. 8 is an enlarged block diagram illustrating a boosting drive circuit of FIG. 7.

FIG. 8 is an enlarged block diagram illustrating a boosting drive circuit of FIG. 7.

Referring to FIGS. 1, 7 and 8, the boosting drive circuit BST may include a boosting condition determining part 140 and a boosting driving part BSD.

The boosting condition determining part 140 receives the local dimming signals LDS from the local dimming drive circuit LDD. The boosting condition determining part 140 determines whether or not the local dimming signals LDS satisfies the boosting conditions to control the boosting driving part BSD. In the present embodiment, the boosting condition determining part 140 may perform step S10 and step S20 as described in FIG. 1.

The boosting driving part BSD is controlled by the boosting condition determining part 140 to output the boosting local dimming signals BLDS by using the local dimming signals LDS. That is, when the local dimming signals LDS satisfies the boosting conditions, the boosting driving part BSD boosts a portion of the local dimming signals LDS to output the boosted local dimming signals LDS. When, the local dimming signals LDS do not satisfy boosting conditions, the boosting driving part boosts driving part BSD outputs the local dimming signals LDS. In the present embodiment, the boosting driving part BSD may perform the remaining steps except for step S10 and step S20 as described in FIG. 1.

When the local dimming signals LDS satisfy the boosting conditions, the boosting driving part BSD boosts the predetermined local dimming signals corresponding to the predetermined light source blocks to the reference luminance value and gradually decreases a boosting luminance of the predetermined local dimming signals at the reference luminance value after a light adaptation time of an observer's eye.

For example, the boosting driving part BSD may include a counting part 150, a counting reset part 160 and a boosting part 170.

The counting part 150 counts the boosting frame number from an initial boosting frame to a current boosting frame at the predetermined local dimming signals. In the present embodiment, the counting part 150 may perform step S40 of FIG. 4.

The counting reset part 160 may be controlled by the boosting condition determining part 140 to control the counting part 150 to reset the boosting frame number.

For example, when the local dimming signals LDS satisfy the counting reset conditions or the local dimming signals LDS do not satisfy the boosting conditions, the counting reset part 160 may control the counting part 150 to reset the boosting frame number. In the present embodiment, the counting reset part 160 may perform step S50 and step S55 of FIG. 1.

The boosting part 170 receives the boosting frame number from the counting part 150 to output the boosting local dimming signals BLDS in response to the boosting frame number.

For example, the boosting part 170 may boost the predetermined dimming signals to the reference luminance value when the boosting frame number is smaller than the threshold number N, and the boosting part 170 may decrease a boosting luminance of the predetermined local dimming signal when the boosting frame number is greater than or equal to the threshold frame number N.

The boosting part 170 may include a boosting frame number comparing part 172 and a boosting executing part 174 electrically connected to the boosting frame comparing part 172.

The boosting frame number comparing part 172 receives the boosting frame number from the counting part 150, and compares with the boosting frame number and the threshold frame number N to control the boosting executing part 174. In the present embodiment, the boosting frame number 172 may perform step S60 of FIG. 6.

The boosting executing part 174 is controlled by the boosting frame number comparing part 172 to output the boosting local dimming signals BLDS by using the local dimming signals LDS.

For example, when the boosting frame number is smaller than the threshold frame number N, the boosting executing part 174 may output the boosting local dimming signals BLDS which the predetermined local dimming signals are boosted to the reference luminance value to be generated. Moreover, when the boosting frame number is greater than or equal to the threshold frame number N, the boosting executing part 174 may output the boosting local dimming signals BLDS which the predetermined local dimming signals are gradually decreased per frame. When the local dimming signals LDS do not satisfy the boosting conditions, the boosting executing part 174 may output the boosting local dimming signals BLDS that is substantially same as the local dimming signals LDS. In the present embodiment, the boosting executing part 174 may perform step S70, step S80 and step S90 as described in FIG. 1.

According to the present embodiment, when the local dimming signals satisfy the boosting conditions, the predetermined local dimming signals corresponding to the predetermined light source blocks are boosted to the reference luminance value, and then a boosting luminance of the predetermined local dimming signals is gradually decreased after the light adaptation time of an observer' eye.

A human eye has characteristics which adapts to a boosting luminance of the predetermined local dimming signals that is boosted to the reference luminance value after the light adaptation time. Thus, in order to effectively boost the local dimming signals, a boosting luminance of the predetermined local dimming signals may be decreased to the reference luminance value after the light adaptation time.

As described above, as a boosting luminance of the predetermined local dimming signals are gradually decreased after the light adaptation time, power consumption required to boost the local dimming signals may be decreased.

Example Embodiment 2

Figure 9:
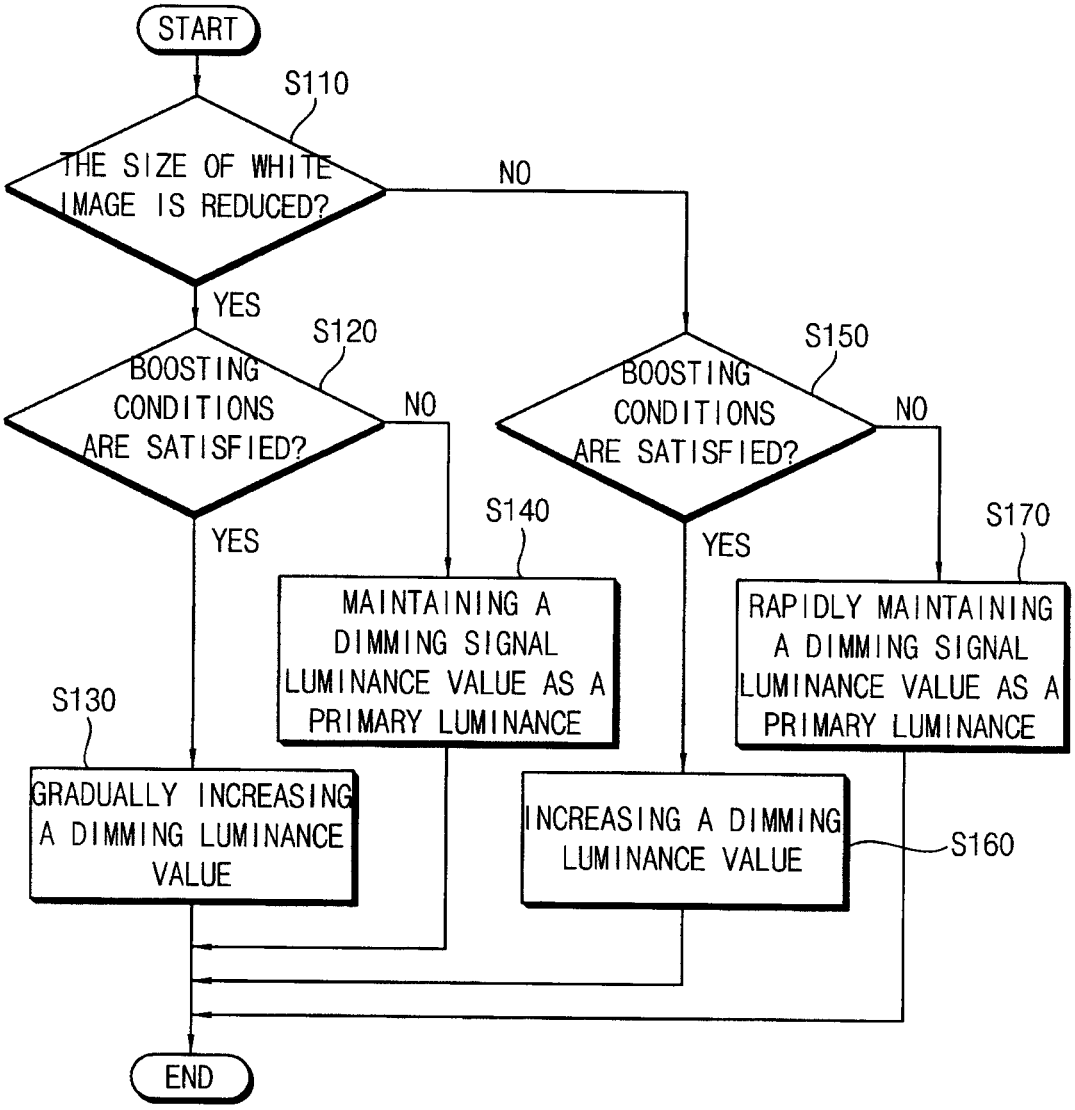
FIG. 9 is a flowchart illustrating a method of boosting a local dimming signal according to Embodiment 2 of the present invention.
Figure 10:
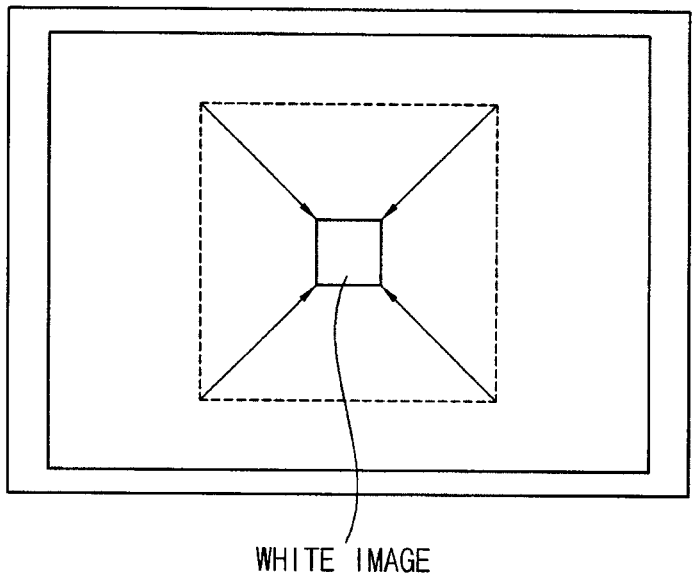
FIG. 10 is a plan view illustrating a state in which the size of a white image is decreased in FIG. 9.
Figure 12:
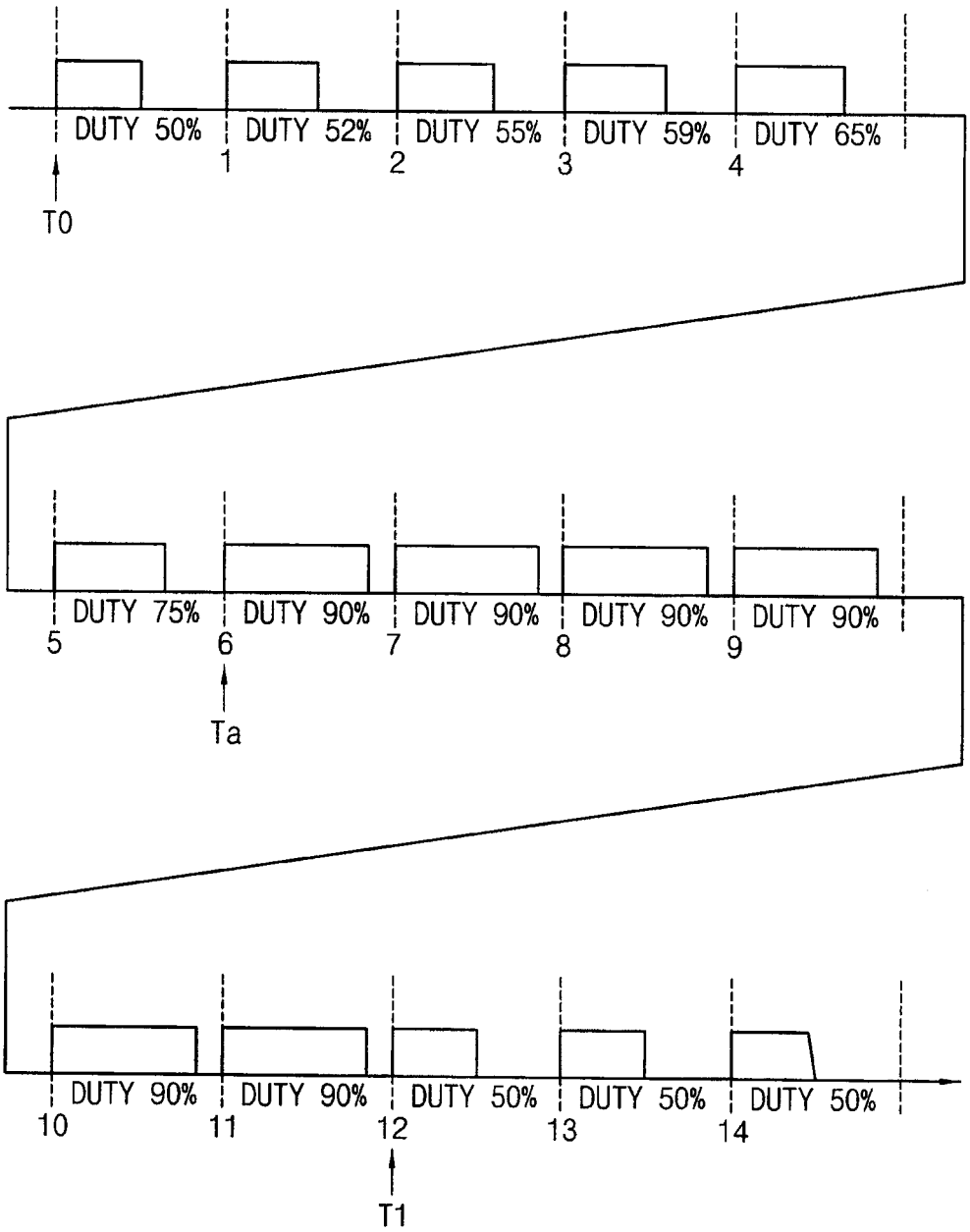
FIG. 12 is a waveform diagram illustrating a duty variation of dimming signals that are boosted in local dimming signals.

FIG. 9 is a flowchart illustrating a method of boosting a local dimming signal according to Embodiment 2 of the present invention. FIG. 10 is a plan view illustrating a state in which the size of a white image is decreased in FIG. 9. FIG. 1 is a graph repeatedly illustrating a variation of the luminance of dimming signals that are boosted in local dimming signals. FIG. 12 is a waveform diagram illustrating a duty variation of dimming signals that are boosted in local dimming signals.

The display device used for the local dimming signal boosting method according to the present embodiment is substantially the same as the display device of FIGS. 1 to 8 except for at least a boosting method. Thus, the same reference numbers will be used to refer to the same or like parts as those described in Embodiment 1 and any further explanation concerning the above elements will be omitted.

Referring to FIGS. 9 to 12, in order to boost a local dimming signal in accordance with the present embodiment, an image signals is received from an external device by frame, and it is determined whether or not the size of a white image is reduced as described in FIG. 10 by using pixel data included in the image signals (step Silo). In the present embodiment, the reason which detects a variation of size of the white image is that glare that is seen by a human eye is varied in accordance with the size of the white image. A detailed description for a relationship between a side of the white image and the glare luminance will be described with reference to the following drawings.

When it is determined that the side of the white image is reduced, it is again determined whether the white image is boosted or not. That is, local dimming signals for driving each of the light source blocks 320 are calculated by using a pixel data of the image signal applied by frame, and then it is determined whether or not the calculated local dimming signals satisfies the boosting conditions (step S120).

The boosting conditions may include that the number of dark blocks of the light source blocks 320, which is lower than a reference luminance value, is greater than a reference number. That is, the boosting conditions may include that the number of dimming signals of a dark luminance is greater than the reference value, which has a low duty than a reference value among the local dimming signals calculated by frame. For example, the boosting condition may include that the number of dimming signals of the dark luminance having a duty of less than about 30% among one hundred twenty-eight light source blocks 320 is sixty-four or more.

As a result of determining whether the boosting conditions are satisfied or not, when the number of dark blocks satisfies the boosting conditions, a luminance value corresponding to all or a portion of the remaining dimming signals except for the dimming signals of the dark luminance is gradually increased to be boosted (step S130). Here, the remaining dimming signals may be defined as a bright luminance dimming signals. In the present embodiment, a luminance value of the bright luminance dimming signals represents that a luminance value of light actually generated when the bright luminance dimming are applied to a light source blocks 320 to be driven.

On the other hand, when it is determined that the number of dark blocks do not satisfy the boosting conditions, a luminance value of the bright luminance dimming signals is maintaining to a primary luminance value L1 that is an original luminance (step S140).

When it is determined that the size of the white image is reduced, it may be determined that the white image will be boosted in accordance with the boosting condition (step S150). Here, the case which the size of the white image is not reduced may represents that the size of the white image is uniform or increased.

When the boosting conditions are satisfied so that it is determined that the white image will be boosted, a luminance value of the bright luminance dimming signals is rapidly increased from the primary luminance value L0 to a reference luminance value L1 at a boosting start time T0, then it is maintaining to an end time T1 that is an end time of the boosting to the reference luminance value L1, and then it is again returned to the primary luminance value (step S160). On the other hand, when the boosting conditions are not satisfied, a boosting operation for a luminance value of the bright luminance dimming signals is not performed to maintain the primary luminance value (step S170).

Hereinafter, at the condition which the size of the white image is reduced, a boosting process of the remaining dimming signals will be explained in detail with reference to FIG. 11.

During from the boosting start time T0 to a boosting intermediate time Ta, a luminance value of the bright luminance dimming signals is gradually increased from the primary luminance value L1 to a reference luminance value L2. In the present embodiment, a luminance value of the bright luminance dimming signals may be increased in an exponential function. A time interval between the boosting start time T0 and the boosting intermediate time Ta is equal to or shorter than a light adaptation time T-lap in which human eye becomes adapted to glare.

Then, a luminance value of the bright luminance dimming signals that are increased to the reference luminance value L2 is maintaining from the boosting end time T1 to the reference luminance value L2, and then it is returned to the primary luminance value L1.

Accordingly, when a luminance value of the bright luminance dimming signals is gradually increased to the boosting intermediate time Ta that is before the light adaptation time T-lap, power consumption, which is required to boost the light source block 320 corresponding to the bright luminance dimming signals, may be decreased by a size AR2 that is hatched, in comparison with a luminance value of the bright luminance dimming signals is rapidly increased from the boosting start time T0 to the reference luminance value L2.

Hereinafter, referring to FIG. 12, at the condition which the size of the white image is reduced, a boosting process of the bright luminance dimming signals will be explained for example variation of duty of frame unit.

During from the boosting start time T0 to the boosting intermediate time Ta, the duty width of the bright luminance dimming signals is gradually increased per frame. In the present embodiment, an increasing of the duty width of the bright luminance dimming signals may be increased by an exponential function per frame. Then, the duty width of the bright luminance dimming signals is maintained in an increased state to the boosting end time T1, and then it is returned to a state before the duty width is increased.

For example, the duty width of the bright luminance dimming signals may be increased about 50% per frame to be about 90% at sixth frame corresponding to the boosting intermediate time Ta. Then, the duty width of the bright luminance dimming signals is maintaining to an increased state to eleventh frame corresponding to the boosting end time T1, and then it is again returned to about 50%.

The method of boosting the bright luminance dimming signals may be performed in a method of increasing the duty width of the bright luminance dimming signals as described in FIG. 12. Alternatively, the method of boosting the bright luminance dimming signals may be performed through a method which increases amplitude of the bright luminance dimming signals. Still alternatively, the method of boosting the bright luminance dimming signals may be performed through a method which increases duty width and amplitude of the bright luminance dimming signals.

Hereinafter, a boosting the luminance dimming signals by gradually increasing a luminance value of the bright luminance dimming signals after being reduced the size of the white image will be described.

Figure 13:
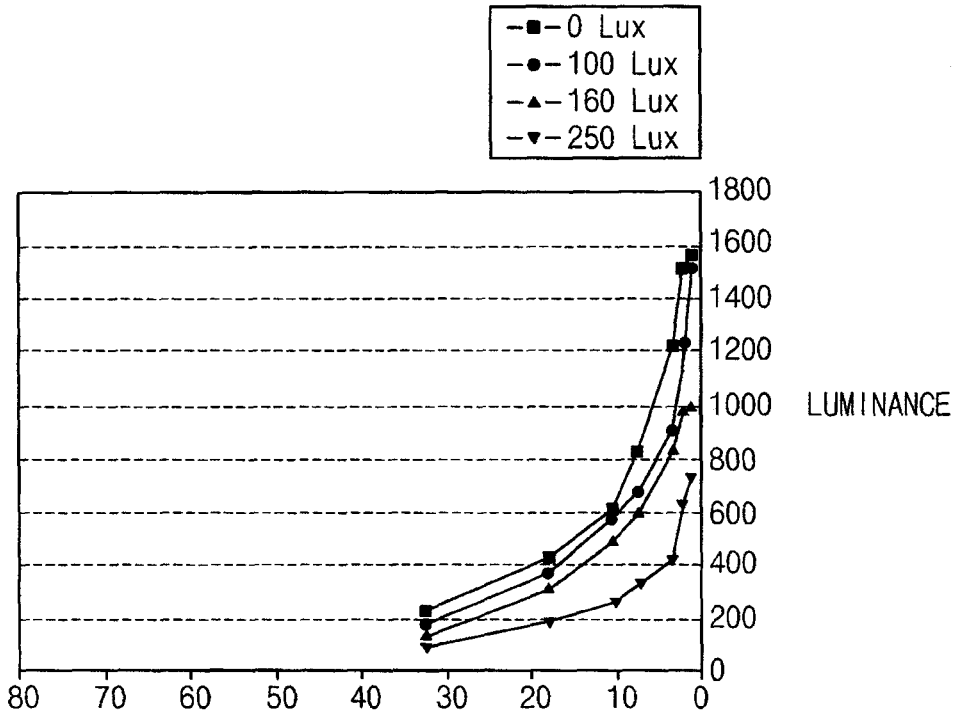
FIG. 13 is a graph illustrating a glare luminance value by an illuminance in accordance with the size of a white image.

FIG. 13 is a graph illustrating a glare luminance value by an illuminance in accordance with the size of a white image. Here, X-axis represents an angle relative to fovea and the size of the white image in a human eye, and Y-axis represents a luminance value of glare sensed by a human eye. That is, the graph of FIG. 13 is luminance values at a position in which observers sense glare in the eyes when an image which the size of a white image is varied on a black image background is observed by ten observers at a display quality testing room of 0, 100, 160 and 250 lux.

Referring to FIG. 13, a glare luminance value sensed by a human eye is varied in accordance with the size of the white image. For example, when the size of the white image is reduced from about 100% to about 0.1%, it is recognized that the glare luminance value is gradually increased. Here, it is recognized that an increasing of a glare luminance value may be approximately increased by an exponential function form.

Moreover, the glare luminance value in a human eye is varied in accordance with a solid angle in a human eye. For example, it is recognized that the glare luminance value is decreased when the solid angle is increased. Here, a variation of the glare luminance value in accordance with the solid angle may be approximately coincided with a distribution of a cone cell according to the solid angle in a human eye. The cone cell is distributed at the center of a yellow spot of a retina, and is consisted of cells cognizing visible light of red, green and blue colors.

As a result, when the solid angle is $\omega$ [cd/m$^2$] and the size of the white image is A [m$^2$], the glare luminance value varies in proportion to $\omega^{-0.25}$, and the glare fit luminance value varies in proportion to $A^{-0.25}$.

Figure 11:
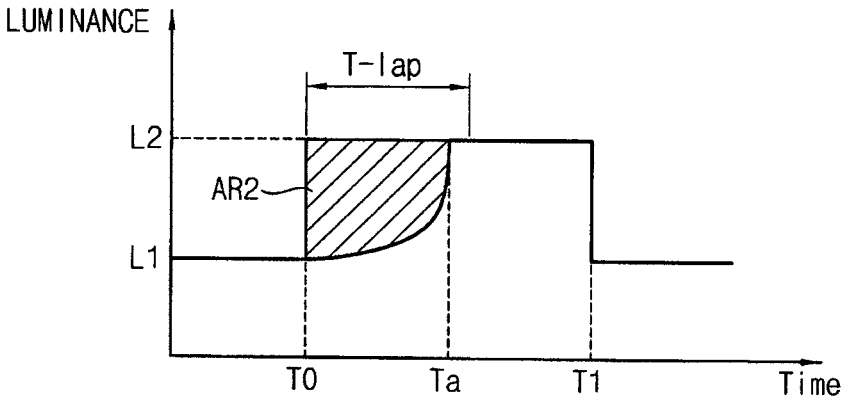
FIG. 11 is a graph repeatedly illustrating a variation of the luminance of dimming signals that are boosted in local dimming signals.

In FIG. 11, it is recognized that a first variation tendency in which a luminance value of the bright luminance dimming signals is increased from the boosting start time T0 to the boosting intermediate time Ta may be substantially similar with a second variation tendency in which the glare luminance value according to the size of the white image or a third variation tendency in which a distribution of a cone cell according to the solid angle. Thus, the result of the first variation tendency may be estimated by considering the second and third variation tendency. That is, a fit curve equation of a glare luminance may be calculated through the second and third variation tendencies, and the first variation tendency may be calculated through the fit curve equation of the glare luminance. For example, the fit curve equation of the glare luminance is as follows:

$$GlareLum = \left(230 + \frac{4}{9}E\right)\frac{1}{\sqrt[4]{\omega}} - 250 = \left(230 + \frac{4}{9}\frac{\pi Lb}{\beta}E\right)\frac{1}{\sqrt[4]{\omega}} - 250 \quad \text{Equation 1}$$

wherein 'E' is an illuminance [1×], 'Lb' is the background luminance [cd/m$^2$], '$\omega$' is the solid angle of a window at the observer's eye [cd/m$^2$], and '$\beta$' is the luminance factor.

In the fit curve equation of the glare luminance, a glare luminance is in proportion to an illuminance 'E' and a background luminance 'Lb' of a background image which surrounds a white image, and is inverse proportion to $\omega^{-0.25}$ and a luminance factor $\beta$.

In the present embodiment, a human eye senses a luminance through cone cells distributed throughout a whole retina when the size of the white image is great, so that glare is sensed in a condition of low luminance; however, a human eye senses a luminance through a cone cell distributed throughout the center of a retina when the size of the white image is small, glare is sensed in a condition of high luminance.

Therefore, when the size of the white image is reduced from about 100% to about 0.1%, a luminance value of the bright luminance dimming signal may be increased in similar with a distribution cone cell according to the solid angle or a variation of a glare luminance according to the size of the white image. When a state in which all of the cone cells are excited is changed to a state in which a portion of the cone cells are excited, it is enough to sense glare even though a luminance value applied to the cone cell is gradually increased.

As described above, according to the present invention, when the luminance of light source blocks that are boosted is gradually decreased before the light adaptation time or luminance of light source blocks that will be boosted is gradually increased to the light adaptation time, power consumption required to boost the light source blocks may be decreased.

The foregoing is illustrative of the present teaching of invention and is not to be construed as limiting thereof. Although a few example embodiments of the present disclosure of invention have been described, those skilled in the art will readily appreciate from the foregoing that many modifications are possible in the example embodiments without materially departing from the novel teachings and advantages of the present disclosure of invention. Accordingly, all such modifications are intended to be included within the scope of the present teachings invention. In the claims, means-plus-function clauses are intended to cover the structures described herein as performing the recited function and not only structural equivalents but also functionally equivalent structures. Therefore, it is to be understood that the foregoing is illustrative of the present disclosure of invention and is not to be construed as limited to the specific example embodiments disclosed, and that modifications to the disclosed example embodiments, as well as other example embodiments, are intended to be included within the scope of the teachings.

What is claimed is:

1. A method of selectively controlling individualized boosting and re-dimming of individual ones of local light sourcing blocks of a backlit display whose image is to be observed by an observer, the method comprising:

in response to a supplied image signal, determining whether or not respective local dimming signals, which are to be applied for individually driving respective light sourcing blocks on a per frame basis, satisfy a predetermined set of boosting qualifying conditions; and in response to said determining indicating that the boosting qualifying conditions are satisfied for a respective light sourcing block, beginning boosting at a first time point (T0) of the respective local dimming signal corresponding to the respective light sourcing block which qualifies for boosting from a primary luminance value greater than zero to a predetermined reference luminance value and continuing the boosting at the predetermined reference luminance value and from the first time point (T0) so as to provide the predetermined reference luminance value by the respective light sourcing block until an intermediate time point (Ta), and then, at the intermediate time point (Ta), beginning a gradual decrease of the boosting of the respective local dimming signal to thereby gradually decrease from the predetermined reference luminance value back to the primary luminance value from the intermediate time point (Ta) to a boosting finishing time point (T1), where an elapsed time (T-elapsed) between the first time point (T0) and the intermediate time point (Ta) is greater than zero and less than a light adaptation period (T-LAP) of an observer's eye, the light adaptation period (T-LAP) of the observer's eye being a time in which a human eye becomes adapted to glare, wherein an end of the light adaptation period (T-LAP) of the observer's eye is between the intermediate time point (Ta) and the boosting finishing time point (T1); and wherein each of the respective local dimming signals is decreased from the predetermined reference luminance value to the primary luminance value greater than zero and maintained during a predetermined period.

2. The method of claim 1, wherein the boosting of the respective local dimming signal to the reference luminance value, and the subsequent gradual decreasing of the respectively boosted luminance comprises:

counting a number of display frames (hereinafter, the number of boosting frames) over which the respective local dimming signal is boosted, starting from a first boosting frame to a current boosting frame of the respective local dimming signal; and boosting the respective local dimming signal to the reference luminance value when the counted number of boosting frames is smaller than that of a predetermined threshold number of frames, and decreasing the boosting luminance of the respective local dimming signal when the counted number of boosting frames is greater than or equal to that of threshold number.

3. The method of claim 2, wherein a time corresponding to the threshold number of frames is less than or equal to the light adaptation period of the observer's eye.

4. The method of claim 2, wherein boosting the respective local dimming signal to the reference luminance value, and gradually decreasing the boosting luminance further comprises:

resetting the count of the number of boosting frames when the respective local dimming signal satisfies a predetermined set of counting reset conditions.

5. The method of claim 4, wherein the counting reset conditions includes that at least one of the local dimming signals is changed differently from a local dimming signal of a previous frame.

6. The method of claim 2, further comprising:

resetting the count of the number of boosting frames when the local dimming signal does not satisfy the boosting qualifying conditions.

7. The method of claim 1, wherein a luminance of the respective local dimming signal after the light adaptation period has elapsed is gradually decreased to the primary luminance value.

8. The method of claim 7, wherein the reference luminance value has a range of about 110% to about 500% with respect to the primary luminance value.

9. The method of claim 8, wherein the reference luminance value is the maximum luminance value that can be sourced at the respective light sourcing block.

10. The method of claim 7, wherein the luminance of the respective local dimming signal after the light adaptation period has elapsed is decreased in a linear form or an exponential function form from the reference luminance value to the primary luminance value.

11. The method of claim 7, wherein the gradual decreasing of the luminance of the respective local dimming signal after the light adaptation period has elapsed is performed by decreasing at least one of a duty and an amplitude of the respective local dimming signal.

12. The method of claim 1, wherein the boosting qualifying conditions include that a set of remaining light sourcing blocks (hereinafter, remaining local dimming blocks having corresponding, remaining dimming signals), from which remaining dimming signals the respective local dimming signal is excluded, can realize a black luminance called for by the supplied image signal, and the remaining local dimming blocks occupy more than a predetermined reference percent of the image area with respect to all of the light sourcing blocks.

13. The method of claim 12, wherein the maximum value of the duty at the remaining local dimming signals corresponding to the black luminance has a range of about 10% to about 40%.

14. The method of claim 12, wherein the reference percent has a range of about 45% to about 55%.

15. A boosting drive circuit for use in a backlit display whose image is to be observed by an observer, where the display has individually boost-able and re-dimmable ones of local light sourcing blocks, the boosting drive circuit comprising:

a boosting condition determining part configured to produce a plurality of local dimming signals corresponding to an image signal supplied to the display, the boosting condition determining part being further configured to optionally cause boosting of respective ones of the produced local dimming signals respectively used for individually driving corresponding ones of the light sourcing blocks on a per frame basis and the boosting condition determining part being configured for determining whether or not the to be boosted local dimming signals will respectively satisfy predetermined boosting qualifying conditions; and a boosting driving part being controlled by the boosting condition determining part, the boosting driving part being configured for individually controlling the boosting of optionally boosted ones of the respective local dimming signals corresponding to the respectively boosted light sourcing blocks such that boosting is from respective primary luminance values greater than zero to respective reference luminance values when the respective local dimming signals are determined to satisfy the boosting qualifying conditions, and such that the boosting includes a gradual decreasing of the boosting luminance of the respectively boosted local dimming signals from the respective reference luminance values back to the respective primary luminance values from an intermediate time point (Ta) to a boosting finishing time point (T1), the boosting is begun at a first time point (T0), wherein an elapsed time (T-elapsed) between the first time point (T0) and the intermediate time point (Ta) is greater than zero and less than a light adaptation period (T-LAP) of an observer's eye, the light adaptation period (T-LAP)

of the observer's eye being a time in which a human eye becomes adapted to glare, and wherein an end of the light adaptation period (T-LAP) of the observer's eye is between the intermediate time point (Ta) and the boosting finishing time point (T1); and wherein the respective local dimming signals are decreased from the respective predetermined reference luminance values to the respective primary luminance values greater than zero and maintained during a predetermined period.

16. The boosting drive circuit of claim 15, wherein the boosting driving part comprises:

a counting part counting the number of frames (hereinafter, a boosting frame number) which the predetermined dimming signal is boosted from a first boosting frame to a current boosting frame; and a boosting part boosting the predetermined local dimming signal to the reference luminance value when the boosting frame number is smaller than the number of threshold frames, and decreasing the boosting luminance of the predetermined local dimming signal when the boosting frame number is greater than or equal to the number of threshold frames.

17. The boosting drive circuit of claim 16, wherein the boosting driving part further comprises:

a counting resetting part controlling the counting part to reset the boosting frame number when the local dimming signals satisfy counting reset conditions.

18. The boosting drive circuit of claim 17, wherein the counting reset part controls the counting part to reset the boosting frame number when the local dimming signals satisfy the boosting conditions.

19. A display apparatus comprising:

a display unit configured for displaying images using supplied lights;

a backlight unit disposed below the display unit, the backlight unit comprising a plurality of light source blocks respectively configured for providing the respective lights to the display unit; and a local dimming controller unit comprising a local dimming drive circuit receiving an image signal from an external device to generate respective local dimming signals for individually driving the respective light source blocks in response to the image signal, and a boosting drive circuit for receiving the local dimming signals from the local dimming drive circuit on a per frame basis, the boosting drive circuit comprising:

a boosting condition determining part configured for determining whether or not each of the local dimming signals respectively satisfies a set of predetermined boosting qualifying conditions; and a boosting driving part controllable by the boosting condition determining part, the boosting driving part being configured for individually boosting each respective local dimming signal corresponding to a respective light source block from a primary luminance value greater than zero to a reference luminance value when the respective local dimming signal satisfies the boosting conditions, and gradually decreasing the boosting luminance of the respective local dimming signal from the reference luminance value back to the primary luminance value from an intermediate time point (Ta) to a boosting finishing time point (T1), the boosting is begun at first time point (T0), wherein an elapsed time (T-elapsed) between the first time point (T0) and the intermediate time point (Ta) is greater than zero and less than a light adaptation period (T-LAP) of an observer's eye, the light adaptation period (T-LAP) of the observer's eye being a time in which a human eye becomes adapted to glare, and wherein an end of the light adaptation period (T-LAP) of the observer's eye is between the intermediate time point (Ta) and the boosting finishing time point (T1); and wherein each of the respective local dimming signals is decreased from the reference luminance values to the primary luminance values greater than zero and maintained during a predetermined period.

20. The display apparatus of claim 19, wherein the local dimming controller unit provides the display unit with an image driving signal in response to the image signal.

* * * * *